US011828128B2

(12) United States Patent
Al-Mousa et al.

(10) Patent No.: US 11,828,128 B2
(45) Date of Patent: Nov. 28, 2023

(54) CONVERTIBLE BELL NIPPLE FOR WELLBORE OPERATIONS

(71) Applicant: Saudi Arabian Oil Company, Dhahran (SA)

(72) Inventors: Ahmed Al-Mousa, Dhahran (SA); Bader M. Alahmad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 51 days.

(21) Appl. No.: 17/140,298

(22) Filed: Jan. 4, 2021

(65) Prior Publication Data

US 2022/0213752 A1 Jul. 7, 2022

(51) Int. Cl.

| | |
|---|---|
| ***E21B 33/06*** | (2006.01) |
| ***E21B 33/068*** | (2006.01) |
| ***E21B 33/037*** | (2006.01) |
| ***E21B 33/038*** | (2006.01) |

(52) U.S. Cl.

CPC ..... *E21B 33/06* (2013.01); *E21B 33/037* (2013.01); *E21B 33/038* (2013.01); *E21B 33/068* (2013.01)

(58) Field of Classification Search

CPC ..... E21B 27/005; E21B 33/06; E21B 33/037; E21B 33/038; E21B 33/068

See application file for complete search history.

(56) References Cited

U.S. PATENT DOCUMENTS

| | | | |
|---|---|---|---|
| 880,404 | A | 2/1908 | Sanford |
| 1,033,655 | A | 7/1912 | Baker |
| 1,258,273 | A | 3/1918 | Titus et al. |
| 1,392,650 | A | 10/1921 | Mcmillian |
| 1,491,066 | A | 4/1924 | Patrick |
| 1,580,352 | A | 4/1926 | Ercole |
| 1,591,264 | A | 7/1926 | Baash |
| 1,621,947 | A | 3/1927 | Moore |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.

(Continued)

*Primary Examiner* — Nicole Coy
*Assistant Examiner* — Nicholas D Wlodarski
(74) *Attorney, Agent, or Firm* — Fish & Richardson P.C.

(57) ABSTRACT

A bell nipple includes a downhole end configured to sealingly couple to an uphole-end of a blow-out preventer. An uphole end of the bell nipple includes a first set of threads along an inner surface of the bell nipple. A thread saver is configured to be received by the uphole end. The thread saver is configured to protect the first set of threads from impact. An extension sub is configured to be received by the uphole end. The extension sub includes a downhole end with a second set of threads configured to engage with the first set of threads. An uphole end of the extension sub includes a third set of threads configured receive a well tool.

14 Claims, 5 Drawing Sheets

(56) References Cited

U.S. PATENT DOCUMENTS 1,638,494 A 8/1927 Lewis et al.
1,789,993 A 1/1931 Switzer
1,896,236 A 2/1933 Howard
1,896,482 A 2/1933 Crowell
1,897,297 A 2/1933 Brown
1,906,933 A * 5/1933 Standlee ..... F04B 47/00 166/131
1,949,498 A 3/1934 Frederick et al.
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,211,206 A * 8/1940 Howard ..... E21B 43/10 166/158
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,947,362 A 8/1960 Smith
2,965,175 A 12/1960 Ransom
2,965,177 A 12/1960 Le Bus et al.
2,965,183 A 12/1960 Le Bus et al.
3,005,506 A 10/1961 Le Bus et al.
3,023,810 A 3/1962 Anderson
3,116,799 A 1/1964 Lemons
3,147,536 A 9/1964 Lamphere
3,225,828 A 12/1965 Wisenbaker et al.
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,437,136 A 4/1969 Young
3,667,721 A 6/1972 Vujasinovic
3,729,986 A * 5/1973 Leonard ..... E21B 21/08 73/152.34
3,747,674 A 7/1973 Murray
3,752,230 A 8/1973 Bernat et al.
3,897,038 A 7/1975 Le Rouax
3,915,426 A 10/1975 Le Rouax
4,030,354 A 6/1977 Scott
4,039,798 A 8/1977 Lyhall et al.
4,042,019 A 8/1977 Henning
4,059,155 A 11/1977 Greer
4,099,699 A 7/1978 Allen
4,190,112 A 2/1980 Davis
4,227,573 A 10/1980 Pearce et al.
4,254,983 A 3/1981 Harris
4,276,931 A 7/1981 Murray
4,296,822 A 10/1981 Ormsby
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,467,996 A 8/1984 Baugh
4,515,212 A 5/1985 Krugh
4,538,684 A 9/1985 Sheffield
4,562,888 A 1/1986 Collet
4,603,578 A 8/1986 Stolz
4,616,721 A 10/1986 Furse
4,696,502 A 9/1987 Desai
4,796,668 A * 1/1989 Depret ..... F16L 57/005 138/96 T
4,834,184 A 5/1989 Streich et al.
4,836,289 A * 6/1989 Young ..... E21B 33/072 166/85.4
4,869,321 A 9/1989 Hamilton
4,877,085 A 10/1989 Pullig, Jr.
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,054,833 A 10/1991 Bishop et al.
5,060,737 A 10/1991 Mohn
5,117,909 A 6/1992 Wilton et al.
5,129,956 A 7/1992 Christopher et al.
5,176,208 A 1/1993 Lalande et al.
5,178,219 A 1/1993 Streich et al.
5,197,547 A 3/1993 Morgan
5,203,646 A 4/1993 Landsberger et al.
5,295,541 A 3/1994 Ng et al.
5,330,000 A 7/1994 Givens et al.
5,358,048 A 10/1994 Brooks
5,392,715 A 2/1995 Pelrine
5,456,312 A 10/1995 Lynde et al.
5,507,346 A 4/1996 Gano et al.
5,580,114 A 12/1996 Palmer
5,584,342 A 12/1996 Swinford
5,605,366 A 2/1997 Beeman
5,639,135 A 6/1997 Beeman
5,667,015 A 9/1997 Harestad et al.
5,673,754 A 10/1997 Taylor
5,678,635 A 10/1997 Dunlap et al.
5,685,982 A 11/1997 Foster
5,806,596 A 9/1998 Hardy et al.
5,833,001 A 11/1998 Song et al.
5,842,518 A 12/1998 Soybel et al.
5,881,816 A 3/1999 Wright
5,924,489 A 7/1999 Hatcher
5,944,101 A 8/1999 Hearn
6,070,665 A 6/2000 Singleton et al.
6,112,809 A 9/2000 Angle
6,130,615 A 10/2000 Poteet
6,138,764 A 10/2000 Scarsdale et al.
6,155,428 A 12/2000 Bailey et al.
6,247,542 B1 6/2001 Kruspe et al.
6,276,452 B1 8/2001 Davis et al.
6,371,204 B1 4/2002 Singh et al.
6,378,627 B1 4/2002 Tubel et al.
6,491,108 B1 12/2002 Slup et al.
6,510,947 B1 1/2003 Schulte et al.
6,595,289 B2 7/2003 Tumlin et al.
6,637,511 B2 10/2003 Linaker
6,679,330 B1 1/2004 Compton et al.
6,688,386 B2 2/2004 Cornelssen
6,698,712 B2 3/2004 Milberger et al.
6,729,392 B2 5/2004 DeBerry et al.
6,768,106 B2 7/2004 Gzara et al.
6,808,023 B2 10/2004 Smith et al.
6,811,032 B2 11/2004 Schulte et al.
6,880,639 B2 4/2005 Rhodes et al.
6,899,178 B2 5/2005 Tubel
6,913,084 B2 7/2005 Boyd
7,049,272 B2 5/2006 Sinclair et al.
7,051,810 B2 5/2006 Halliburton

(56) References Cited

U.S. PATENT DOCUMENTS

| | | | |
|---|---|---|---|
| 7,096,950 | B2 | 8/2006 | Howlett et al. |
| 7,117,956 | B2 | 10/2006 | Grattan et al. |
| 7,150,328 | B2 | 12/2006 | Marketz et al. |
| 7,188,674 | B2 | 3/2007 | McGavern, III et al. |
| 7,188,675 | B2 | 3/2007 | Reynolds |
| 7,218,235 | B1 | 5/2007 | Rainey |
| 7,231,975 | B2 | 6/2007 | Lavaure et al. |
| 7,249,633 | B2 | 7/2007 | Ravensbergen et al. |
| 7,267,179 | B1 | 9/2007 | Abel |
| 7,275,591 | B2 | 10/2007 | Allen et al. |
| 7,284,611 | B2 | 10/2007 | Reddy et al. |
| 7,303,010 | B2 | 12/2007 | de Guzman et al. |
| 7,398,832 | B2 | 7/2008 | Brisco |
| 7,405,182 | B2 | 7/2008 | Verrett |
| 7,418,860 | B2 | 9/2008 | Austerlitz et al. |
| 7,424,909 | B2 | 9/2008 | Roberts et al. |
| 7,488,705 | B2 | 2/2009 | Reddy et al. |
| 7,497,260 | B2 | 3/2009 | Telfer |
| 7,591,305 | B2 | 9/2009 | Brookey et al. |
| 7,600,572 | B2 | 10/2009 | Slup et al. |
| 7,617,876 | B2 | 11/2009 | Patel et al. |
| 7,621,324 | B2 | 11/2009 | Atencio |
| 7,712,527 | B2 | 5/2010 | Roddy |
| 7,735,564 | B2 | 6/2010 | Guerrero |
| 7,762,323 | B2 | 7/2010 | Frazier |
| 7,802,621 | B2 | 9/2010 | Richards et al. |
| 7,934,552 | B2 | 5/2011 | La Rovere |
| 7,965,175 | B2 | 6/2011 | Yamano |
| 8,002,049 | B2 | 8/2011 | Keese et al. |
| 8,056,621 | B2 | 11/2011 | Ring et al. |
| 8,069,916 | B2 | 12/2011 | Giroux et al. |
| 8,201,693 | B2 | 6/2012 | Jan |
| 8,210,251 | B2 | 7/2012 | Lynde et al. |
| 8,376,051 | B2 | 2/2013 | McGrath et al. |
| 8,453,724 | B2 | 6/2013 | Zhou |
| 8,496,055 | B2 | 7/2013 | Mootoo et al. |
| 8,579,024 | B2 | 11/2013 | Mailand et al. |
| 8,596,463 | B2 | 12/2013 | Burkhard |
| 8,726,983 | B2 | 5/2014 | Khan |
| 8,770,276 | B1 | 7/2014 | Nish et al. |
| 8,899,338 | B2 | 12/2014 | Elsayed et al. |
| 8,991,489 | B2 | 3/2015 | Redlinger et al. |
| 9,079,222 | B2 | 7/2015 | Burnett et al. |
| 9,109,433 | B2 | 8/2015 | DiFoggio et al. |
| 9,133,671 | B2 | 9/2015 | Kellner |
| 9,163,469 | B2 | 10/2015 | Broussard et al. |
| 9,181,782 | B2 | 11/2015 | Berube et al. |
| 9,212,532 | B2 | 12/2015 | Leuchtenberg et al. |
| 9,234,394 | B2 | 1/2016 | Wheater et al. |
| 9,359,861 | B2 | 6/2016 | Burgos |
| 9,410,066 | B2 | 8/2016 | Ghassemzadeh |
| 9,416,617 | B2 | 8/2016 | Wiese et al. |
| 9,551,200 | B2 | 1/2017 | Read et al. |
| 9,574,417 | B2 | 2/2017 | Laird et al. |
| 9,657,213 | B2 | 5/2017 | Murphy et al. |
| 9,976,407 | B2 | 5/2018 | Ash et al. |
| 10,087,752 | B2 | 10/2018 | Bedonet |
| 10,198,929 | B2 | 2/2019 | Snyder |
| 10,266,698 | B2 | 4/2019 | Cano et al. |
| 10,280,706 | B1 | 5/2019 | Sharp, III |
| 10,301,898 | B2 | 5/2019 | Orban |
| 10,301,989 | B2 | 5/2019 | Imada |
| 10,584,546 | B1 | 3/2020 | Ford |
| 10,626,698 | B2 | 4/2020 | Al-Mousa et al. |
| 10,837,254 | B2 | 11/2020 | Al-Mousa et al. |
| 2002/0053428 | A1 | 5/2002 | Maples |
| 2003/0047312 | A1 | 3/2003 | Bell |
| 2003/0098064 | A1 | 5/2003 | Kohli et al. |
| 2003/0132224 | A1 | 7/2003 | Spencer |
| 2004/0040707 | A1 | 3/2004 | Dusterhoft et al. |
| 2004/0065446 | A1 | 4/2004 | Tran et al. |
| 2004/0074819 | A1 | 4/2004 | Burnett |
| 2004/0095248 | A1 | 5/2004 | Mandel |
| 2005/0056427 | A1 | 3/2005 | Clemens et al. |
| 2005/0167097 | A1 | 8/2005 | Sommers et al. |
| 2005/0263282 | A1 | 12/2005 | Jeffrey et al. |
| 2006/0082462 | A1 | 4/2006 | Crook |
| 2006/0105896 | A1 | 5/2006 | Smith et al. |
| 2007/0137528 | A1 | 6/2007 | Le Roy-Ddelage et al. |
| 2007/0181304 | A1 | 8/2007 | Rankin et al. |
| 2007/0204999 | A1 | 9/2007 | Cowie et al. |
| 2007/0256867 | A1 | 11/2007 | DeGeare et al. |
| 2008/0087439 | A1 | 4/2008 | Dallas |
| 2008/0236841 | A1 | 10/2008 | Howlett et al. |
| 2008/0251253 | A1 | 10/2008 | Lumbye |
| 2008/0314591 | A1 | 12/2008 | Hales et al. |
| 2009/0194290 | A1 | 8/2009 | Parks et al. |
| 2009/0250220 | A1 | 10/2009 | Stamoulis |
| 2010/0258289 | A1 | 10/2010 | Lynde et al. |
| 2010/0263856 | A1 | 10/2010 | Lynde et al. |
| 2010/0270018 | A1 | 10/2010 | Howlett |
| 2011/0036570 | A1 | 2/2011 | La Rovere et al. |
| 2011/0056681 | A1 | 3/2011 | Khan |
| 2011/0067869 | A1 | 3/2011 | Bour et al. |
| 2011/0168411 | A1 | 7/2011 | Braddick |
| 2011/0203794 | A1 | 8/2011 | Moffitt et al. |
| 2011/0259609 | A1 | 10/2011 | Hessels et al. |
| 2011/0273291 | A1 | 11/2011 | Adams |
| 2011/0278021 | A1 | 11/2011 | Travis et al. |
| 2012/0012335 | A1 | 1/2012 | White et al. |
| 2012/0067447 | A1 | 3/2012 | Ryan et al. |
| 2012/0118571 | A1 | 5/2012 | Zhou |
| 2012/0170406 | A1 | 7/2012 | DiFoggio et al. |
| 2012/0285684 | A1 | 11/2012 | Crow et al. |
| 2013/0101361 | A1* | 4/2013 | Rolland ..... B65G 53/30 406/12 |
| 2013/0134704 | A1 | 5/2013 | Klimack |
| 2013/0213654 | A1 | 8/2013 | Dewey et al. |
| 2013/0240207 | A1 | 9/2013 | Frazier |
| 2013/0269097 | A1 | 10/2013 | Alammari |
| 2013/0296199 | A1 | 11/2013 | Ghassemzadeh |
| 2014/0138091 | A1 | 5/2014 | Fuhst |
| 2014/0158350 | A1 | 6/2014 | Castillo et al. |
| 2014/0231068 | A1 | 8/2014 | Isaksen |
| 2014/0251616 | A1 | 9/2014 | O'Rourke et al. |
| 2015/0013994 | A1 | 1/2015 | Bailey et al. |
| 2015/0096738 | A1 | 4/2015 | Atencio |
| 2016/0076327 | A1 | 3/2016 | Glaser et al. |
| 2016/0084034 | A1 | 3/2016 | Roane et al. |
| 2016/0130914 | A1 | 5/2016 | Steele |
| 2016/0160106 | A1 | 6/2016 | Jamison et al. |
| 2016/0237810 | A1 | 8/2016 | Beaman et al. |
| 2016/0281458 | A1 | 9/2016 | Greenlee |
| 2016/0305215 | A1 | 10/2016 | Harris et al. |
| 2016/0340994 | A1 | 11/2016 | Ferguson et al. |
| 2017/0044864 | A1 | 2/2017 | Sabins et al. |
| 2017/0058628 | A1 | 3/2017 | Wijk et al. |
| 2017/0067313 | A1 | 3/2017 | Connell et al. |
| 2017/0089166 | A1 | 3/2017 | Sullivan |
| 2018/0003002 | A1* | 1/2018 | Bowen, Jr. ..... E21B 34/02 |
| 2018/0010418 | A1 | 1/2018 | VanLue |
| 2018/0030809 | A1 | 2/2018 | Harestad et al. |
| 2018/0187498 | A1 | 7/2018 | Soto et al. |
| 2018/0209565 | A1 | 7/2018 | Lingnau |
| 2018/0245427 | A1 | 8/2018 | Jimenez et al. |
| 2018/0252069 | A1 | 9/2018 | Abdollah et al. |
| 2019/0024473 | A1 | 1/2019 | Arefi |
| 2019/0049017 | A1 | 2/2019 | McAdam et al. |
| 2019/0087548 | A1 | 3/2019 | Bennett et al. |
| 2019/0186232 | A1 | 6/2019 | Ingram |
| 2019/0203551 | A1 | 7/2019 | Davis et al. |
| 2019/0284894 | A1 | 9/2019 | Schmidt et al. |
| 2019/0284898 | A1 | 9/2019 | Fagna et al. |
| 2019/0316424 | A1 | 10/2019 | Robichaux et al. |
| 2019/0338615 | A1 | 11/2019 | Landry |
| 2020/0032604 | A1 | 1/2020 | Al-Ramadhan |
| 2020/0056446 | A1 | 2/2020 | Al-Mousa et al. |
| 2020/0224511 | A1 | 7/2020 | Dannish |

FOREIGN PATENT DOCUMENTS

| | | |
|---|---|---|
| CA | 2441138 | 3/2004 |
| CA | 2734032 | 6/2016 |
| CN | 203292820 | 11/2013 |

(56) References Cited

FOREIGN PATENT DOCUMENTS

| | | |
|---|---|---|
| CN | 103785923 | 6/2016 |
| CN | 104712320 | 12/2016 |
| CN | 107060679 | 8/2017 |
| CN | 107191152 | 9/2017 |
| CN | 107227939 | 10/2017 |
| DK | 2545245 | 4/2017 |
| DK | 2236742 | 8/2017 |
| EP | 2964874 | 1/2016 |
| EP | 2545245 | 4/2017 |
| GB | 958734 | 5/1964 |
| GB | 2392183 | 2/2004 |
| GB | 2414586 | 11/2005 |
| GB | 2425138 | 10/2006 |
| GB | 2453279 | 1/2009 |
| GB | 2492663 | 1/2014 |
| OA | 5503 A | 4/1981 |
| WO | WO 1989012728 | 12/1989 |
| WO | WO 1996039570 | 12/1996 |
| WO | WO 2002090711 | 11/2002 |
| WO | WO 2010132807 | 11/2010 |
| WO | WO 2012164023 | 12/2012 |
| WO | WO 2013109248 | 7/2013 |
| WO | WO 2015112022 | 7/2015 |
| WO | WO 2016011085 | 1/2016 |
| WO | WO 2016040310 | 3/2016 |
| WO | WO 2016140807 | 9/2016 |
| WO | WO 2017043977 | 3/2017 |
| WO | WO 2018017104 | 1/2018 |
| WO | WO 2018164680 | 9/2018 |
| WO | WO 2019027830 | 2/2019 |
| WO | WO 2019132877 | 7/2019 |
| WO | WO 2019231679 | 12/2019 |

OTHER PUBLICATIONS

Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.

Bautista et al., "Probability-based Dynamic Time Warping for Gesture Recognition on RGB-D data," WDIA 2012: Advances in Depth Image Analysis and Application, 126-135, International Workshop on Depth Image Analysis and Applications, 2012, 11 pages.

Boriah et al., "Similarity Measures for Categorical Data: A Comparative Evaluation," presented at the SIAM International Conference on Data Mining, SDM 2008, Apr. 24-26, 2008, 12 pages.

Bruton et al., "Whipstock Options for Sidetracking," Oilfield Review, Spring 2014, 26:1, 10 pages.

Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.

Edwards, "Construction de modèles stratigraphiques à partir de données éparses, " Stratigraphie, Université de Lorraine, 2017, 133 pages, English abstract.

Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.

Hernandez-Vela et al., "Probability-based Dynamic Time Warping and Bag-of-Visual-and-Depth-Words for human Gesture Recognition in RGB-D," Pattern Recognition Letters, 2014, 50: 112-121, 10 pages.

Herrera and Bann, "Guided seismic-to-well tying based on dynamic time warping," SEG Las Vegas 2012 Annual Meeting, Nov. 2012, 6 pages.

Keogh and Ratanamahatana, "Exact indexing of dynamic time warping," Knowledge and Information Systems, Springer-Verlag London Ltd., 2004, 29 pages.

Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.

Lallier et al., "Management of ambiguities in magnetostratigraphic correlation," Earth and Planetary Science Letters, 2013, 371-372: 26-36, 11 pages.

Lallier et al., "Uncertainty assessment in the stratigraphic well correlation of a carbonate ramp: Method and application of the Beausset Basin, SE France," C. R. Geoscience, 2016, 348: 499-509, 11 pages.

Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.

Nakanishi and Nakagawa, "Speaker-Independent Word Recognition by Less Cost and Stochastic Dynamic Time Warping Method," ISCA Archive, European Conference on Speech Technology, Sep. 1987, 4 pages.

Pels et al., "Automated biostratigraphic correlation of palynological records on the basis of shapes of pollen curves and evaluation of next-best solutions," Paleogeography, Paleoclimatology, Paleoecology, 1996, 124: 17-37, 21 pages.

Pollack et al., "Automatic Well Log Correlation," AAPG Annual Convention and Exhibition, Apr. 3, 2017, 1 page, Abstract Only.

Rudman and Lankston, "Stratigraphic Correlation of Well Logs by Computer Techniques," The American Association of Petroleum Geologists, Mar. 1973, 53:3 (557-588), 12 pages.

Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.

Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.

Sayhi, "peakdet: Peak detection using MATLAB," Jul. 2012, 4 pages.

Scribd.com [online], "Milling Practices and Procedures," retrieved from URL <https://www.scribd.com/document/358420338/Milling-Rev-2-Secured>, 80 pages.

Silva and Koegh, "Prefix and Suffix Invariant Dynamic Time Warping," IEEE Computer Society, presented at the IEEE 16th International Conference on Data Mining, 2016, 6 pages.

Smith and Waterman, "New Stratigraphic Correlation Techniques," Journal of Geology, 1980, 88: 451-457, 8 pages.

Startzman and Kuo, "A Rule-Based System for Well Log Correlation," SPE Formative Evaluation, Society of Petroleum Engineers (SPE), Sep. 1987, 9 pages.

TAM International Inflatable and Swellable Packers, "TAM Scab Liner brochure," Tam International, available on or before Nov. 15, 2016, 4 pages.

Tomasi et al., "Correlation optimized warping and dynamic time warping as preprocessing methods for chromatographic data," Journal of Chemometrics, 2004, 18: 231-241, 11 pages.

Uchida et al., "Non-Markovian Dynamic Time Warping," presented at the 21st International Conference on Pattern Recognition (ICPR), Nov. 11-15, 2012, 4 pages.

Waterman and Raymond, "The Match Game: New Stratigraphic Correlation Algorithms," Mathematical Geology, 1987, 19:2, 19 pages.

Weatherford, "Micro-Seal Isolation System-Bow (MSIS-B)," Weatherford Swellable Well Construction Products, Brochure, 2009-2011, 2 pages.

Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

PCT International Search Report and Written Opinion in International Appln. No. PCT/US2022/011147, dated Mar. 14, 2022, 15 pages.

* cited by examiner

CONVERTIBLE BELL NIPPLE FOR WELLBORE OPERATIONS

TECHNICAL FIELD

This disclosure relates to well tools mounted uphole of a blow-out preventer.

BACKGROUND

During drilling operations, a drill string extends through a bell nipple and blow-out preventer (BOP). The bell nipple receives cuttings and drilling fluids from the wellbore during drilling operations. After receiving the fluids and cuttings, the bell nipple directs the fluid and cuttings to shaker screens, where the cuttings and fluids are separated so that the drilling fluid can be reused.

As a separate operation, a well tool, such as a wireline/slickline tool, is installed atop the blow-out preventer by a shooting nipple. The well tool is exposed to well pressure during operations. Shooting nipples and bell nipples are not interchangeable as the bell nipple relies upon a static column of fluid to contain well pressure, while a shooting nipple seals the wellbore from the surrounding environment. In addition, a bell nipple relies upon the BOP to seal the wellbore in case of well pressure kick. On the other hand, the shooting nipple is install during wireline or slickline operation and relies on wireline/slickline's BOP above it to seal against the wire or the slick in case of well control since the BOP below it can't seal against the wire or the slick.

SUMMARY

This disclosure describes technologies relating to a convertible bell nipple.

An example implementation of the subject matter described within this disclosure is a kit with the following features. A bell nipple includes a downhole end configured to sealingly couple to an uphole-end of a blow-out preventer. An uphole end of the bell nipple includes a first set of threads along an inner surface of the bell nipple. A fluid conduit defines a downward slope fluidically connected to an interior of the bell nipple. An inlet of the fluid conduit is uphole of the downhole end and downhole of the first set of threads. A valve set is positioned in-line with the fluid conduit. The valve set is configured to regulate fluid flow through the conduit. A thread saver is configured to be received by the uphole end. The thread saver is configured to protect the first set of threads from impact. An extension sub is configured to be received by the uphole end. The extension sub includes a downhole end with a second set of threads configured to engage with the first set of threads. An uphole end of the extension sub includes a third set of threads configured receive a well tool.

Aspects of the example kit, which can be combined with the example kit alone or with other aspects, include the following. The first set of threads are ACME threads.

Aspects of the example kit, which can be combined with the example kit alone or with other aspects, include the following. The third set of threads are LTC threads.

Aspects of the example kit, which can be combined with the example kit alone or with other aspects, include the following. The valve set comprises two valves in series.

Aspects of the example kit, which can be combined with the example kit alone or with other aspects, include the following. The two valves are gate valves.

Aspects of the example kit, which can be combined with the example kit alone or with other aspects, include the following. One of the two valves is a hydraulically actuated valve, and the other of the two valves is a manually actuated valve.

Aspects of the example kit, which can be combined with the example kit alone or with other aspects, include the following. The thread saver includes a softer material than the bell nipple.

Aspects of the example kit, which can be combined with the example kit alone or with other aspects, include the following. The thread saver covers an entirety of the first set of threads when installed.

Aspects of the example kit, which can be combined with the example kit alone or with other aspects, include the following. The bell nipple, the valve set, and the extension sub are rated for well pressure.

An example implementation of the subject matter described within this disclosure is a method with the following features. A bell nipple is received by a blow-out preventer. The bell nipple includes ACME threads along an interior surface of an uphole end of the bell nipple. A thread saver is received by the bell nipple.

Aspects of the example method, which can be combined with the example method alone or with other aspects, include the following. An entirety of the ACME threads is covered by the thread saver.

Aspects of the example method, which can be combined with the example method alone or with other aspects, include the following. The thread saver is parted with the bell nipple. An extension sub is received by the bell nipple. The extension sub threadingly engages with the ACME threads. A well tool is received by the extension sub.

Aspects of the example method, which can be combined with the example method alone or with other aspects, include the following. A valve set of the bell nipple is closed.

Aspects of the example method, which can be combined with the example method alone or with other aspects, include the following. The well tool and the extension sub are parted with the bell nipple. The thread saver is received by the bell nipple.

Aspects of the example method, which can be combined with the example method alone or with other aspects, include the following. The well tool is a wireline tool or a lubricator.

Aspects of the example method, which can be combined with the example method alone or with other aspects, include the following. Well pressure is retained by the bell nipple, the extension sub, and the well tool.

Aspects of the example method, which can be combined with the example method alone or with other aspects, include the following. Fluid is flowed through the bell nipple in an uphole direction. Fluid is flowed from the bell nipple through a conduit sloping downhill from a vertical side of the bell nipple.

An example implementation of the subject matter described within this disclosure is a wellstack with the following features. A bell nipple includes a downhole end configured to sealingly couple to an uphole-end of a blow-out preventer. An uphole end of the bell nipple includes ACME threads along an inner surface of the bell nipple. A fluid conduit defines a downward slope fluidically connected to an interior of the bell nipple. An inlet of the fluid conduit is uphole of the downhole end and downhole of the ACME of threads. A valve set is positioned in-line with the fluid conduit. The valve set is configured to regulate fluid flow through the conduit.

Aspects of the example wellstack, which can be combined with the example wellstack alone or with other aspects, include the following. A thread saver is configured to be received by the uphole end. The thread saver is configured to protect the ACME threads from impact. The thread saver includes a softer material than the bell nipple.

Aspects of the example wellstack, which can be combined with the example wellstack alone or with other aspects, include the following. An extension sub is configured to be received by the uphole end. The extension sub includes a downhole end with a second set of ACME threads configured to engage with the ACME threads of the bell nipple and an uphole end with a set of LTC threads configured receive a well tool.

Aspects of the example wellstack, which can be combined with the example wellstack alone or with other aspects, include the following. A lubricator or wireline tool sealingly engaged to the uphole end of the extension sub by the LTC threads.

Particular implementations of the subject matter described in this disclosure can be implemented so as to realize one or more of the following advantages. The time needed to switch between wireline/slickline and drilling operations is significantly reduced by the subject matter described within this disclosure.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

During drilling operations, a bell nipple is often changed out for a shooting nipple for slickline or wireline operations. The process of changing the bell nipple for a shooting nipple and reattaching the bell nipple after the slickline or wireline operations, takes a significant amount of time and often hampers the overall drilling rate of penetration. This increase in drilling time increases total rig time and delays the onset of hydrocarbon production.

This disclosure relates to a reconfigurable bell nipple assembly that includes threaded connections, a thread saver, and adapters for other tools, such as a wireline lubricator. The assembly is reconfigurable, saving time during the drilling process, as the bell nipple does not need to be removed and reassembled to use other tools, such as a wireline lubricator. Additionally, the bell nipple includes valves on the outlet to pressure isolate, throttle fluid flow, or both, from the bell nipple.

Figure 1:
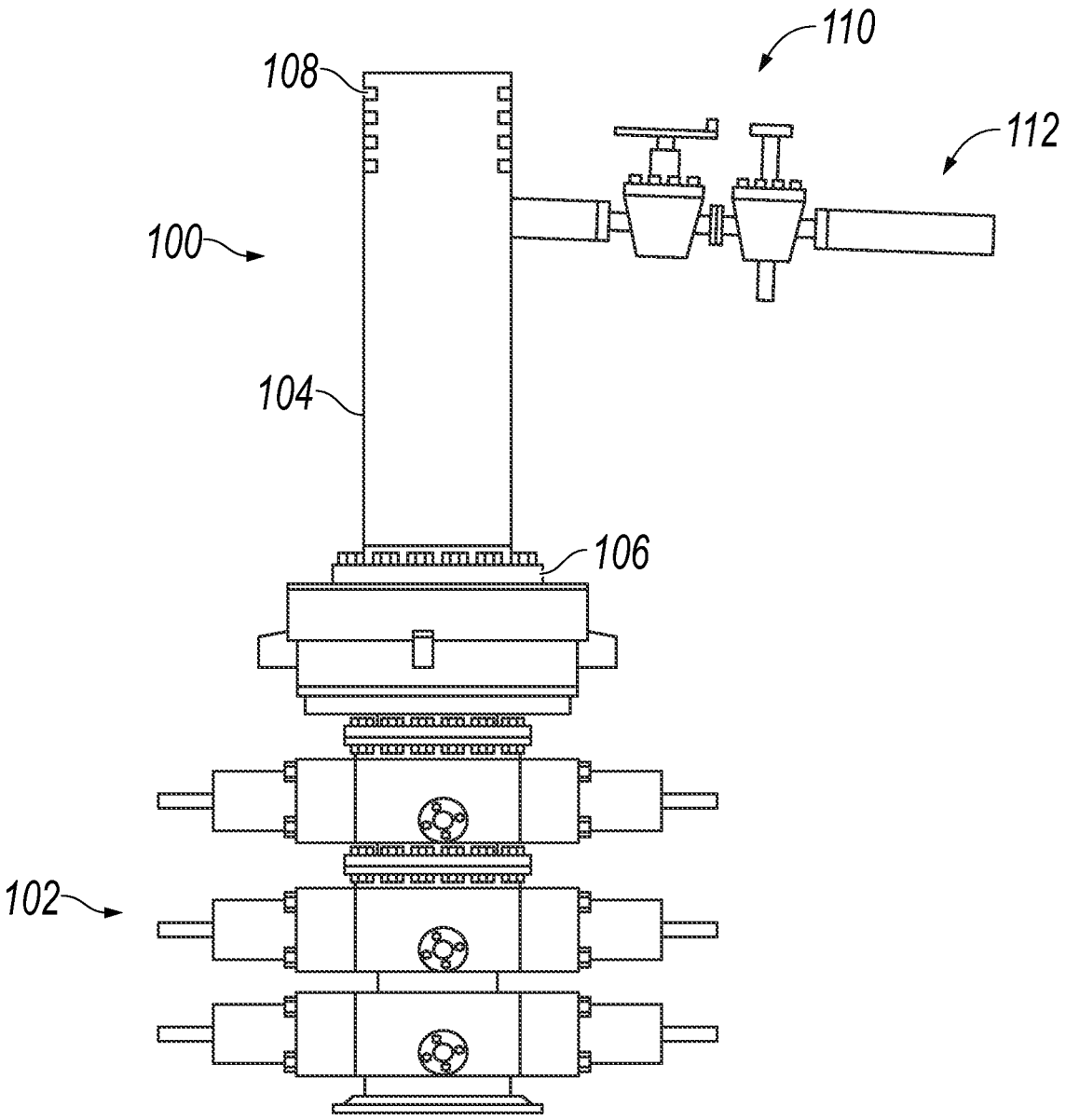
FIG. 1 is a side view of a convertible bell nipple.

FIG. 1 is a side view of a convertible bell nipple 100 resting atop a blow-out preventer (BOP) 102. The bell nipple 100 includes an open pipe 104 with a bolted, flanged connection 106 at a downhole end of the bell nipple 100. Typically, the flanged connection is bolted to the upper end of the BOP 102 with a gasket appropriate for the service compressed between the BOP 102 and the bell nipple 100. While described as using a bolted, gasketed connection, other connections can be used without departing from this disclosure.

The uphole end of the bell nipple 100 is typically open to atmosphere (when configured to act as a standard bell nipple). The bell nipple 100 also includes ACME threads 108 at an uphole end of the bell nipple. In some implementations, the ACME threads 108 are along an inner surface of the bell nipple 100. That is, the uphole end of the bell nipple 100 acts as a female portion of a threaded connection. The square profile of ACME threads makes them very robust and resistant to damage. In addition, the square profile reduces the likelyhood of cross threading. While primarily illustrated and described as using ACME threads, the uphole end of the bell nipple 100 can use any type of similarly robust threading. Alternatively or in addition, other quick-connect interfaces can be used without departing from this disclosure, such as a hammer lock connection.

Between the uphole end and the downhole end of the bell nipple 100, a flow conduit 112 is fluidically connected to the open pipe 104. Typically, this conduit 112 has a downhill slope and receives drilling fluid and drill cuttings from the bell nipple 100. The conduit 112 includes one or more valves to regulate, isolate, throttle, or otherwise control a flowrate through the conduit 112. In some implementations, the one or more valves can include a valve set 110. The valve set 110 can include two valves in series. In some implementations, the two valves are gate valves. Such valves are often used for isolation purposes; however, it should be noted that other isolation valves, such as ball valves, can be used without departing from this disclosure. Alternatively or in addition, valves more typically used for throttling applications, such as globe valves, can be used without departing from this disclosure. In some implementations, the valve set 110 can include more than one type of valves. For example, a throttling valve and an isolation valve can be included in series. Valves within the valve set 110 can be manually actuated, hydraulically actuated, or both. For example, one of the valves can be manually actuated, by hand, at the valve location, while another valve of the valve set 110 can be hydraulically actuated, for example, remotely from a control room, or locally at a hydraulic control panel.

Figure 2:
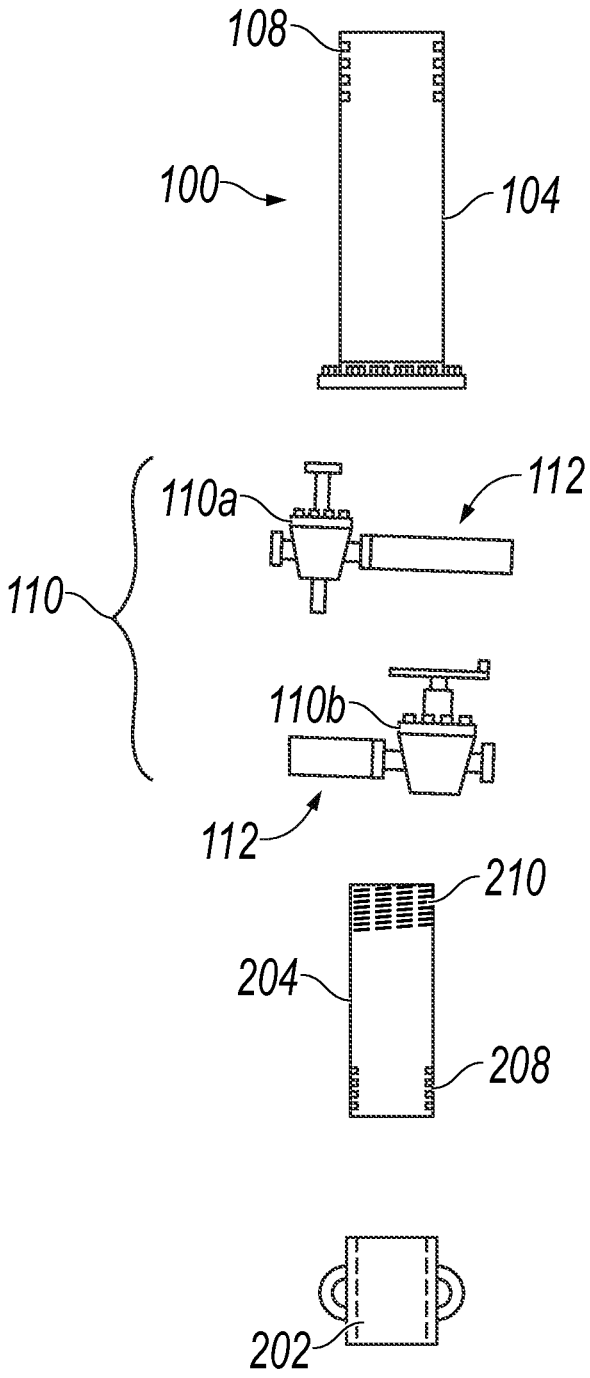
FIG. 2 is an illustrated list of components that can be used with aspects of this disclosure.

FIG. 2 is an illustrated list of components that can be used with aspects of this disclosure. As the bell nipple 100 is reconfigurable, the bell nipple 100 can be combined with various components that can be swapped out depending upon the desired configuration. For example, the pipe 104 can include the valve set 110 and conduit 112. The conduit 112 and valve set 110 can be attached to the pipe 104 and each other in a variety of ways, for example, welded, threaded, or bolted connections can be used. Connections can be connected on-site or in a manufacturing facility. In general, the fluid conduit 112 defines a downward slope. An inlet of the fluid conduit 112 is uphole of the downhole end of the bell nipple 100 and is downhole of the ACME threads. In some implementations, the valve set 110 can include a first valve 110*a* and a second valve 110*b*. In some implementations, the first valve 110*a* is a hydraulic gate valve, and the second valve 110*b* is a manual gat valve.

When the convertible bell nipple 100 is configured as a standard bell nipple, a thread saver 202 is configured to protect the ACME threads 108 when installed at an uphole end of the bell nipple 100. The thread saver 202 creates an interference to prevent drill pipe or other work strings from impacting the ACME threads 108 during operations that require the bell nipple 100. In some implementations, the thread saver 202 is made of a softer material than the bell nipple 100 so that the thread saver 202 itself does not damage the ACME threads 108. Such materials can include brass or an elastomer, such as polycarbonate. In some implementations, composites such as fiber glass or carbon fiber can be used in the thread saver 202. In some implementations, the thread saver 202 covers an entirety of the ACME threads 108 when installed onto the bell nipple 100; however, other thread saver 202 geometries can be used so long as drill pipes and similar work strings are prevented from contacting the ACME threads 108 by the thread saver 202.

When configured as a shooting nipple, an extension sub 204 is threaded into the uphole end of the bell nipple 100. That is, the downhole end of the extension sub 204 includes threads 208 configured to engage with the ACME threads 108 of the bell nipple 100. Typically, the extension sub 204 acts as a male portions of a threaded connection while the bell nipple 100 acts as a female portion of the threaded connection. While primarily described and illustrated in such a configuration, the opposite configuration, with the bell nipple 100 acting as a male portion of a threaded connection and the extension sub 204 acting as a female portion of the threaded connection, can be used without departing from this disclosure. An uphole end of the extension sub 204 includes another set of threads 210 configured to receive a well tool, such as a wireline or slickline tool. While primarily described as using wireline or slickline tools, other wellbore lines, such as e-lines, coiled tubing, and umbilicals, can be use without departing from this disclosure. In some implementations, the threads 210 at the uphole end of the extension sub 204 includes an LTC thread box with LTC threads. While primarily described as using LTC threads, other threaded configurations can be used without departing from this disclosure. Similarly, other quick connect coupling mechanisms can be used, such as a hammer-lock connection.

As the bell nipple 100 can be configured in multiple ways, including pressure containment arrangements, the bell nipple 100, the valve set 110, and the extension sub 204 are rated for an expected well pressure.

Figure 3:
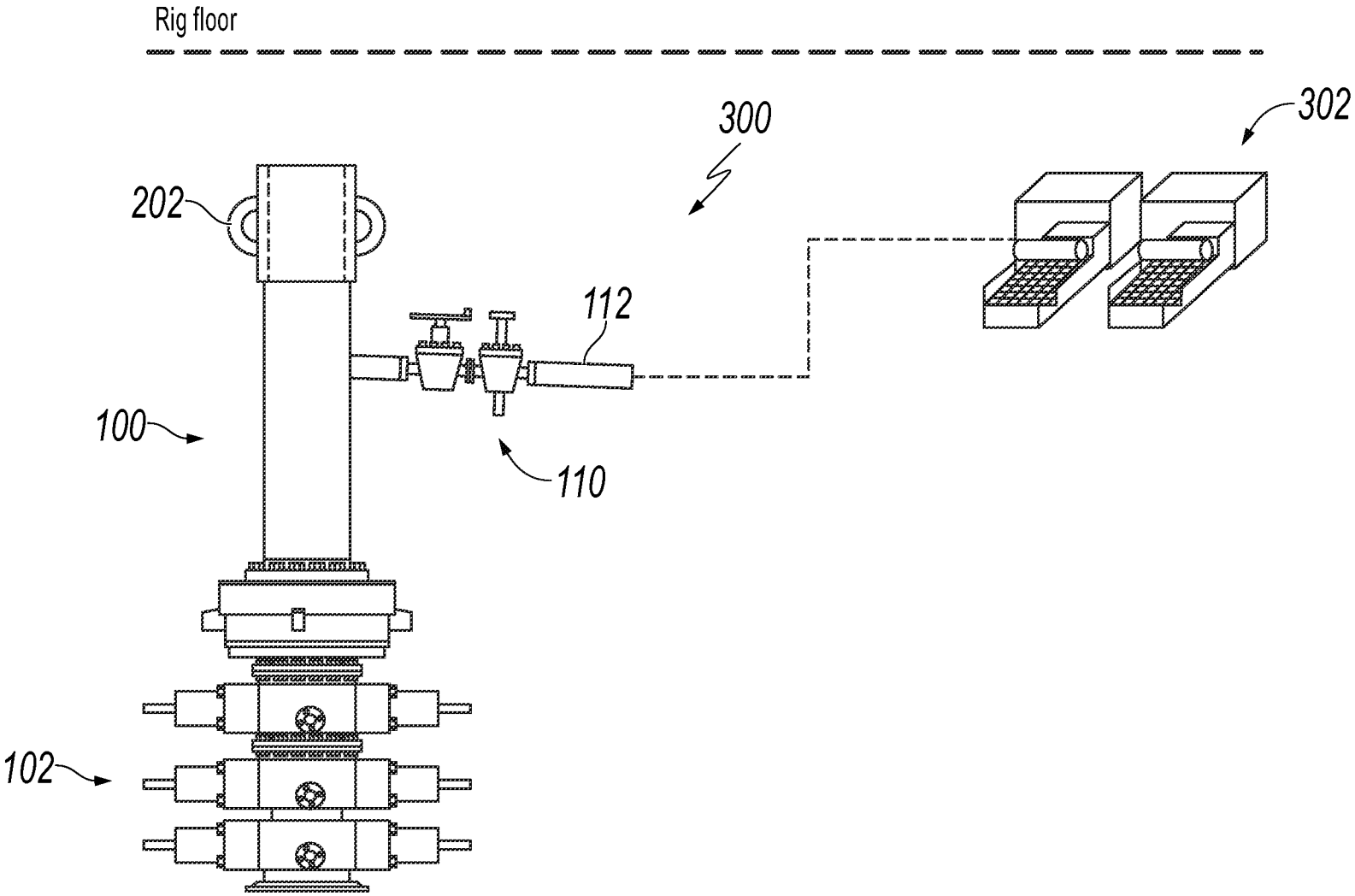
FIG. 3 is an illustration of the convertible bell nipple acting as a bell nipple.

FIG. 3 is an illustration of the convertible bell nipple 100 acting as a standard bell nipple. This configuration is often used during drilling operations when fluids and cuttings are circulated through the wellbore. In this configuration, the wellstack 300 includes the bell nipple 100 with its downhole end sealingly coupled to an uphole end of the BOP 102. The uphole end of the bell nipple includes the ACME threads 108 (not shown) along an inner surface of the bell nipple 100. The fluid conduit 112 defining the downward slope directs fluid from the bell nipple 100 to shaker tables 302 and other drilling fluid processing systems. The valve set 110 positioned in-line with the fluid conduit is configured to regulate fluid flow through the conduit 112, for example, to prevent the bell nipple 100 from overflowing.

The wellstack 300 includes the thread saver at the uphole end of the bell nipple. The thread saver 202 protects the ACME threads 108 (not shown as they are covered by the thread saver 202) from impact, for example, from a drill pipe or similar work string.

Figure 4:
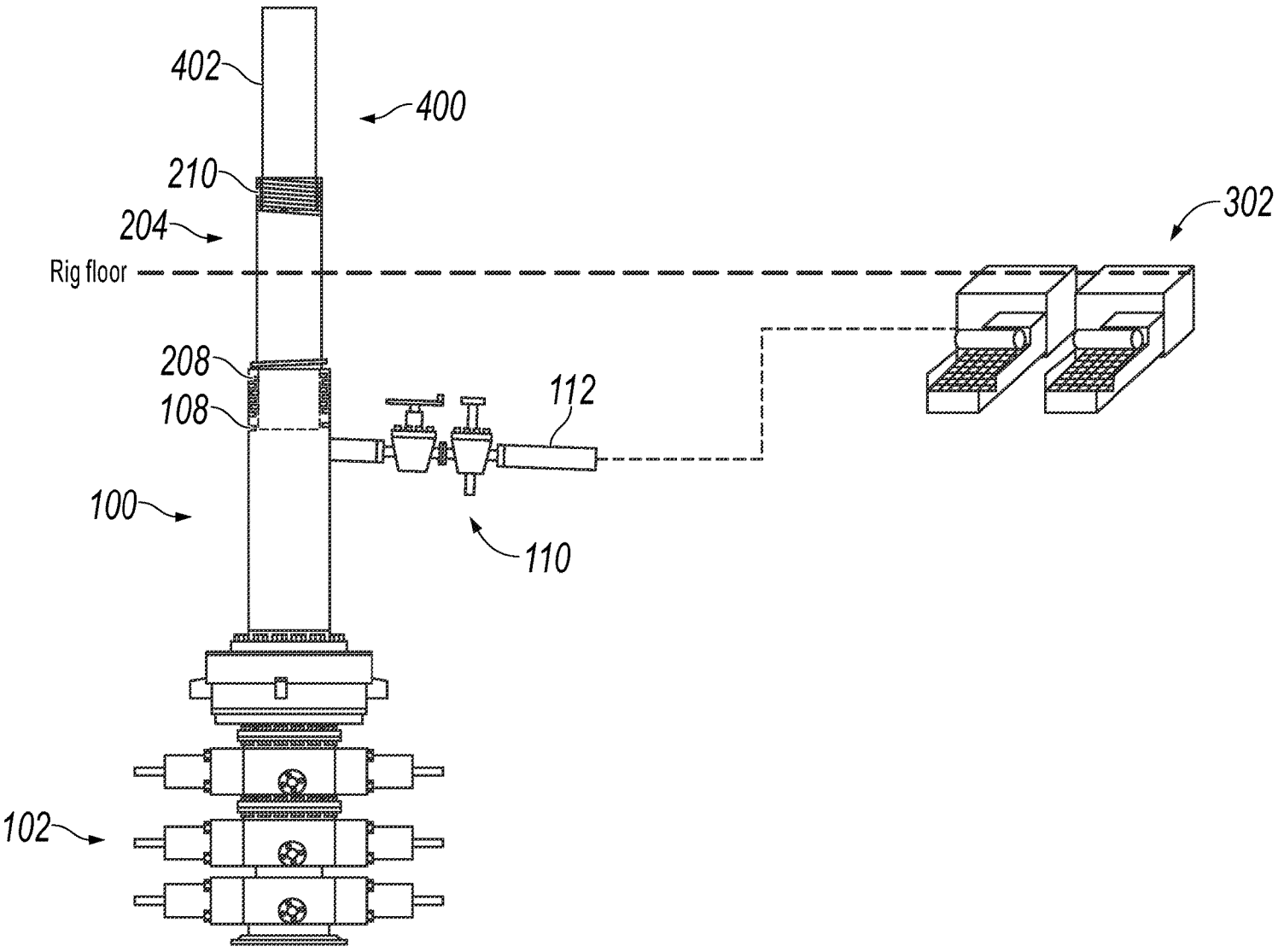
FIG. 4 is an illustration of the convertible bell nipple acting as a well tool adapter, for example, for running a wireline or slickline tool.

FIG. 4 is an illustration of the convertible bell nipple 100 acting as a well tool adapter. In this configurations, the wellstack 400 includes an extension sub 204 coupled to the uphole end of the bell nipple 100. The extension sub 204 mates with the bell nipple 100 by the ACME threads 108 and 208. As illustrated, the extension sub 204 acts as the male portion of the threaded connection. At an uphole end of the extension sub 204, a set of LTC threads 210 receives a well tool 402, for example, a lubricator or wireline tool. The well tool 402 is sealingly engaged to the uphole end of the extension sub 204 by the LTC threads 210. That is, the threaded connection 210 is rated for well pressure. In other words, little to no fluid leaks from the LTC or ACME threads once the components are fully engaged with one another.

Figure 5:
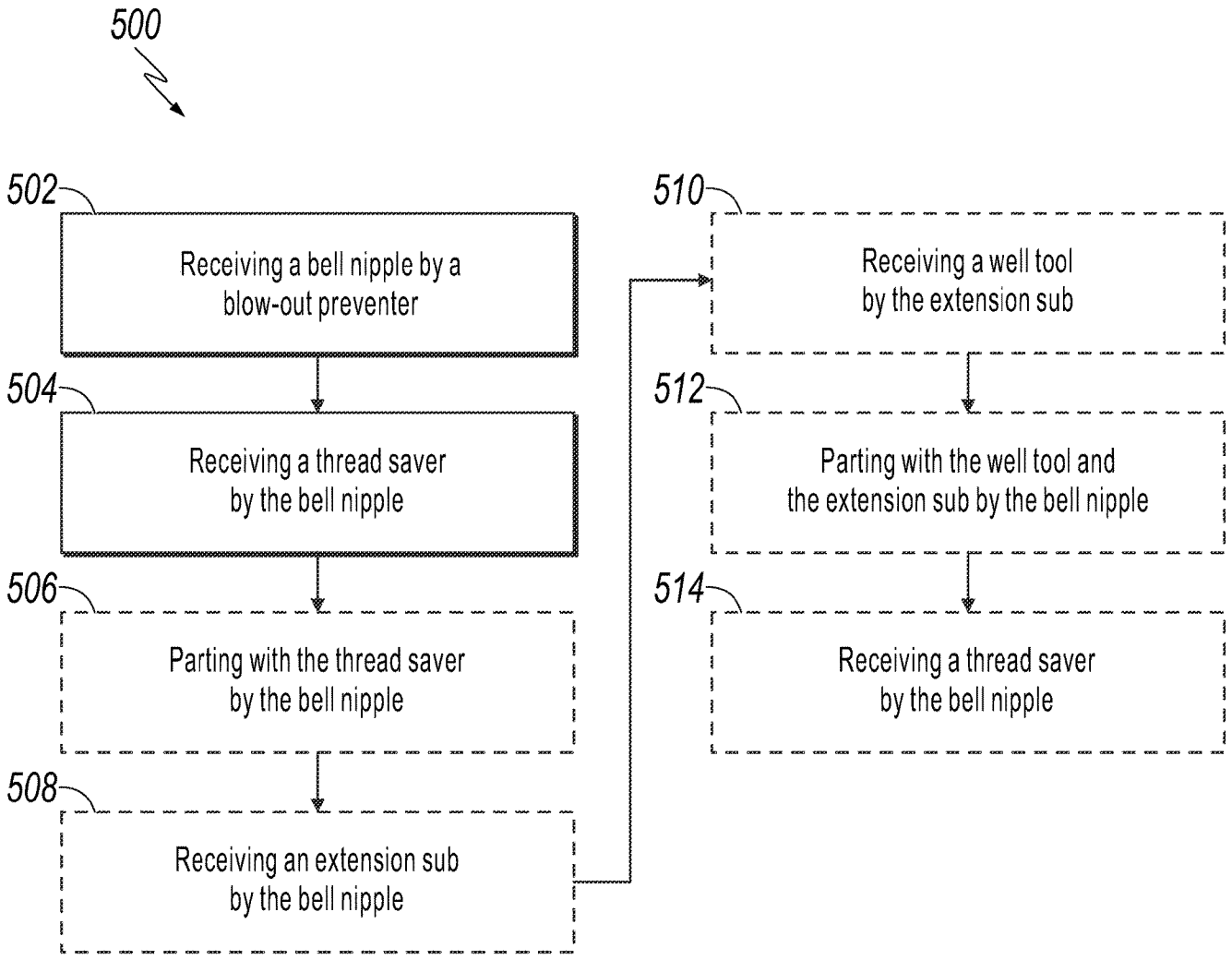
FIG. 5 is a flowchart of a method that can be used with aspects of this disclosure.

FIG. 5 is a flowchart of a method 500 that can be used with aspects of this disclosure. At 502, a bell nipple is received by a blow-out preventer. The bell nipple includes ACME threads along an interior surface of an uphole end of the bell nipple. That is, the bell nipple acts as the female portion of a potential threaded connection. At 504, a thread saver is received by the bell nipple. In some implementations, an entirety of the ACME threads are covered by the thread saver. Regardless of the amount of coverage, the thread saver reduces the damage to the ACME threads potentially caused by drill pipes or other work strings that pass through the bell nipple.

During drilling operations, fluid is flowed through the bell nipple in an uphole direction, and fluid is then flowed from the bell nipple through a conduit sloping downhill from a vertical side of the bell nipple. Typically, the valve set 110 is closed during wireline or slickline operations. The valve set 110 can be actuated to help control the well if the need arises.

In the event that wireline or slickline operations are needed, at 506, the thread saver is parted with, or separated from, the bell nipple. At 508, an extension sub is received by the bell nipple. The extension sub threadingly engages with the ACME threads of the bell nipple. At 510, a well tool is received by the extension sub. The well tool can be a wireline tool, a lubricator, or a similar tool that is exposed to well pressure. Well pressure is retained by the bell nipple, the extension sub, and the well tool during the wireline or slickline operations.

Once the wireline or slickline operations are completed, assuming that additional drilling operations remain, at 512, the well tool and the extension sub are parted from the bell nipple. At 514, the thread saver is received by the bell nipple. After the received by the bell nipple, drilling operations can resume.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination, in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A modifiable bell nipple assembly comprising:

a bell nipple comprising:

a downhole end configured to sealingly couple to an uphole-end of a blow-out preventer;

an uphole end comprising a first set of threads along an inner surface of the bell nipple;

a fluid conduit fluidically connected to an interior of the bell nipple at a downhill slope to direct fluid flowed through the bell nipple away from the bell nipple, an inlet of the fluid conduit being uphole of the downhole end and downhole of the first set of threads; and a valve set positioned in-line with the fluid conduit, the valve set configured to regulate fluid flow through the conduit;

in a first configuration, a thread saver configured to be received by the uphole end, wherein, in the first configuration, the thread saver is configured, when installed onto the uphole end to cover the first set of threads and to protect the first set of threads from impact during operations using the bell nipple in the first configuration, wherein the valve set is configured to be opened in the first configuration; and in a second configuration, an extension sub configured to be received by the uphole end in place of the thread saver, the extension sub comprising:

a downhole end comprising a second set of threads configured to engage with the first set of threads; and an uphole end comprising a third set of threads configured to receive a well tool uphole of the extension sub, wherein the valve set is configured to be closed in the second configuration.

2. The assembly of claim 1, wherein the first set of threads are ACME threads.

3. The assembly of claim 1, wherein the third set of threads are LTC threads.

4. The assembly claim 1, wherein the valve set comprises two valves in series.

5. The assembly claim 4, wherein the two valves are gate valves.

6. The assembly claim 4, wherein one of the two valves is a hydraulically actuated valve, and the other of the two valves is a manually actuated valve, wherein, in the first configuration, the hydraulically actuated valve is configured to be open, and wherein, in the second configuration, the hydraulically actuated valve is configured to be closed.

7. The assembly claim 1, wherein the thread saver comprises a softer material than the bell nipple.

8. The assembly claim 1, wherein the thread saver covers an entirety of the first set of threads when installed.

9. The assembly claim 1, wherein the bell nipple, the valve set, and the extension sub are rated for well pressure.

10. A method comprising:

forming a first configuration of a bell nipple assembly by:

coupling a downhole end of a bell nipple to a blow-out preventer, the bell nipple comprising ACME threads along an interior surface of an uphole end of the bell nipple;

coupling a fluid conduit to an interior of the bell nipple at a downhill slope to direct fluid flowed through the bell nipple away from the bell nipple, an inlet of the fluid conduit being uphole of the downhole end of the bell nipple and downhole of the ACME threads;

positioning a valve set positioned in-line with the fluid conduit; and in the first configuration:

covering, by a thread saver, the ACME threads of the bell nipple when the thread saver is installed onto the bell nipple, and opening the valve set to flow fluid through the conduit; and modifying a configuration of the bell nipple assembly from the first configuration to a second configuration by:

disconnecting the thread saver from the ACME threads of the bell nipple, in place of the thread saver, connecting an extension sub to the ACME threads, and closing the valve set to flow fluid through the conduit.

11. The method of claim 10, wherein connecting the thread saver to the ACME threads comprises covering an entirety of the ACME threads by the thread saver.

12. The method of claim 10, further comprising, in the second configuration:

connecting a well tool to the extension sub.

13. The method of claim 12, wherein the well tool is a wireline tool or a lubricator.

14. The method of claim 12, further comprising retaining well pressure by the bell nipple, the extension sub, and the well tool.

* * * * *